US009715989B2

(12) United States Patent
Dalakos et al.

(10) Patent No.: US 9,715,989 B2
(45) **Date of Patent: *Jul. 25, 2017**

(54) MULTILAYER X-RAY SOURCE TARGET WITH HIGH THERMAL CONDUCTIVITY

(71) Applicant: General Electric Company, Schenectady, NY (US)

(72) Inventors: George Theodore Dalakos, Schenectady, NY (US); Mark Alan Frontera, Ballston Lake, NY (US); Vance Scott Robinson, Schenectady, NY (US)

(73) Assignee: General Electric Company, Niskayuna, NY (US)

( * ) Notice: Subject to any disclaimer, the term of this patent is extended or adjusted under 35 U.S.C. 154(b) by 40 days.

This patent is subject to a terminal disclaimer.

(21) Appl. No.: 14/682,856

(22) Filed: Apr. 9, 2015

(65) Prior Publication Data

US 2016/0300685 A1 Oct. 13, 2016

(51) Int. Cl.
*H01J 35/08* (2006.01)
*H01J 35/12* (2006.01)

(52) U.S. Cl.
CPC ..... *H01J 35/12* (2013.01); *H01J 2235/086* (2013.01); *H01J 2235/088* (2013.01); *H01J 2235/1204* (2013.01)

(58) Field of Classification Search
CPC ..... H01J 2235/088; H01J 2245/086; H01J 2245/1204
See application file for complete search history.

(56) References Cited

U.S. PATENT DOCUMENTS 5,264,801 A * 11/1993 DeCou, Jr. ..... H01J 35/105 378/127
6,463,123 B1 * 10/2002 Korenev ..... G21K 5/10 378/119
9,008,278 B2 * 4/2015 Lee ..... H01J 5/18 378/124
2011/0129068 A1 * 6/2011 Lewalter ..... H01J 35/108 378/127
2013/0195246 A1 * 8/2013 Tamura ..... H01J 35/12 378/62
2013/0308754 A1 * 11/2013 Yamazaki ..... H01J 35/08 378/62
2014/0185778 A1 * 7/2014 Lee ..... H01J 5/18 378/124

* cited by examiner

*Primary Examiner* — Wyatt Stoffa
*Assistant Examiner* — Eliza Osenbaugh-Stewar
(74) *Attorney, Agent, or Firm* — Pabitra K. Chakrabarti

(57) ABSTRACT

In one embodiment, an X-ray source target is provided that includes two or more layers of X-ray generating material at different depths within a source target for an electron beam. In one such embodiment the X-ray generating material in each layer does not extend fully across an underlying substrate surface.

20 Claims, 12 Drawing Sheets

MULTILAYER X-RAY SOURCE TARGET WITH HIGH THERMAL CONDUCTIVITY

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A variety of medical diagnostic, laboratory, security screening, and industrial quality control imaging systems, along with certain other types of systems (e.g., radiation-based treatment systems), utilize X-ray tubes as a source of radiation during operation. Typically, the X-ray tube includes a cathode and an anode. An electron beam emitter within the cathode emits a stream of electrons toward an anode that includes a target that is impacted by the electrons.

A large portion of the energy deposited into the target by the electron beam produces heat within the target, with another portion of the energy resulting in the production of X-ray radiation. Indeed, only about 1% of the energy from the electron beam X-ray target interaction is responsible for X-ray generation, with the remaining 99% resulting in heating of the target. The X-ray flux is, therefore, highly dependent upon the amount of energy that can be deposited into the source target by the electron beam within a given period of time. However, the relatively large amount of heat produced during operation, if not mitigated, can damage the X-ray source (e.g., melt the target). Accordingly, conventional X-ray sources are typically cooled by either rotating or actively cooling the target. However, when rotation is the means of avoiding overheating, the amount of deposited heat is limited by the rotation speed (RPM), target heat storage, radiation and conduction, and the life of the supporting bearings, this limits the amount of deposited heat and X-ray flux. This also increases the overall volume, and weight of the X-ray source systems. When the target is actively cooled, such cooling generally occurs far from the electron beam impact area, which in turn significantly limits the electron beam power that can be applied to the target. In both situations, the restricted heat removal ability of the cooling methods markedly lowers the overall flux of X-rays that are generated by the X-ray tube.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible embodiments. Indeed, the invention may encompass a variety of forms that may be similar to or different from the embodiments set forth below.

In a first embodiment, an X-ray source target is provided. The X-ray source target includes a structure configured to generate X-rays when impacted by an electron beam. The structure includes two or more X-ray generating layers each comprising X-ray generating material extending less than the full extent of the surface of the structure; and at least one thermally-conductive layer between each pair of X-ray generating layers.

In a second embodiment, an X-ray source target is provided. The X-ray source target includes a structure configured to generate X-rays when impacted by an electron beam. The structure includes a substrate; and a multi-layer structure formed on the substrate and only partially covering a cathode-facing surface of the substrate. The multi-layer structure includes alternating layers of X-ray generating material and thermally-conductive material.

In a third embodiment, a method for manufacturing a multi-layer X-ray source target is provided. In accordance with this method, a thermally-conductive substrate is formed. Two or more X-ray generating layers each including X-ray generating material are formed on the thermally conductive substrate. The X-ray generating material in each X-ray generating layer, when formed, extends less than the full extent of the surface of the substrate. Between each X-ray generating layer, a thermally-conductive layer is provided.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
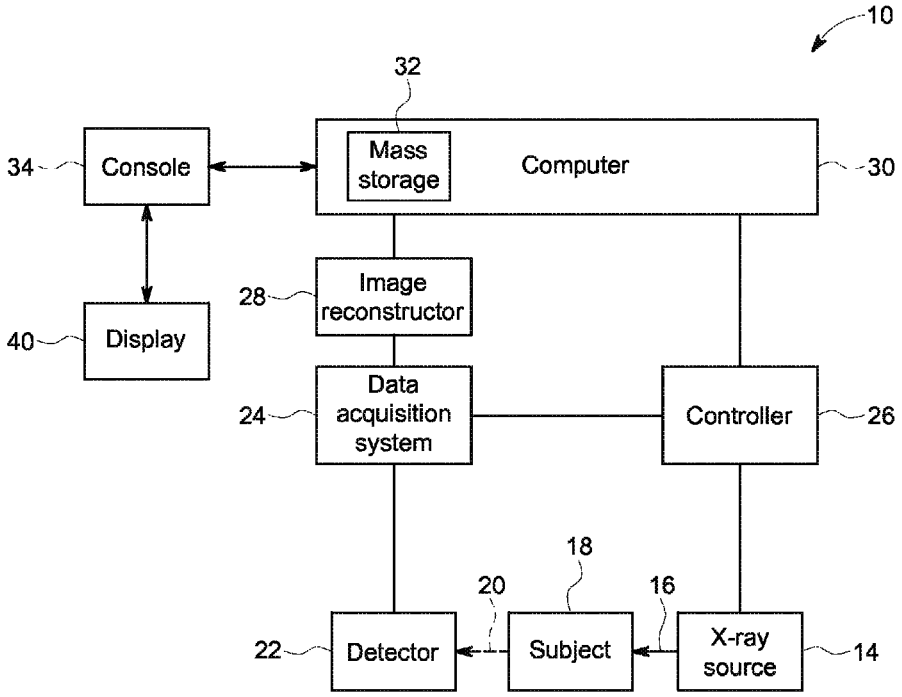
FIG. 1 is a block diagram of an X-ray imaging system, in accordance with aspects of the present disclosure.

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Furthermore, any numerical examples in the following discussion are intended to be non-limiting, and thus additional numerical values, ranges, and percentages are within the scope of the disclosed embodiments.

As noted above, the X-ray flux produced by an X-ray source may depend on the energy and intensity of an electron beam incident on the source's target region. The energy deposited into the target produces, in addition to the X-ray flux, a large amount of heat. Accordingly, during the normal course of operation, a source target is capable of reaching temperatures that, if not tempered, can damage the target. The temperature rise, to some extent, can be managed by convectively cooling, also referred to as "direct cooling", the target. However, such cooling is macroscopic and does not occur immediately adjacent to the electron beam impact area where damage i.e. melting, can occur. Without microscopic localized cooling, the overall flux of X-rays produced by the source is limited, potentially making the source unsuitable for certain applications, such as those requiring high X-ray flux densities. Rotating the target such that the electron beam distributes the energy over a larger area can reduce the target temperature locally but it typically requires larger evacuated volumes and the additional complexity of rotating components such as bearings. Further, vibrations associated with rotating targets become prohibitive for high resolution applications where the required spot size is on the order of the amplitude of the vibration. Accordingly, it would be desirable if the source could be operated in a substantially continuous basis in a manner that enables the output of high X-ray flux.

The present disclosure provides embodiments of systems including an X-ray source having features configured to reduce thermal buildup in the X-ray source. For example, certain of the embodiments discussed herein include a multi-target layer X-ray source having two or more X-ray generation layers (i.e., target layers) and having thermal-conduction material disposed in thermal communication with the X-ray generating materials (either within the target layers or adjacent the target layers). As used herein, a target layer may include a layer or film of X-ray generating material extending in a continuous (i e, uninterrupted or unbroken) manner across the target layer at a given depth or elevation. In other embodiments, a target layer may be formed as a discontinuous or limited region of X-ray generating material within the overall target layer. Thus, a target region as used herein, may reference either a continuous sheet of X-ray generating material or all or part of a discontinuous sheet within such a target layer.

The thermal-conduction materials that are in thermal communication with the X-ray generating materials, either within or between a target layer, generally have a higher overall thermal conductivity than the X-ray generating material. The one or more thermal-conduction materials may be disposed in numerous locations within the X-ray source, including (but not limited to) between the electron beam emitter and the topmost target layer (i.e., as a surface heat-conduction layer), between two of the target layers, within a target layer having limited or discontinuous regions of X-ray generating material, and/or beneath the bottommost target layer (i.e., as an underlying or substrate layer). The one or more thermal-conduction layers may generally be referred to as "heat-dissipating" or "heat-spreading" layers, as they are generally configured to dissipate or spread heat away from the X-ray generating materials impinged on by the electron beam to enable enhanced cooling efficiency. Having better heat conduction within the source target (i.e., anode) allows the end user to operate the source target at higher powers or smaller spot sizes while maintaining the source target at the same target operational temperatures. Alternatively, the source target can be maintained at lower temperatures at the same X-ray source power levels, thus increasing the operational lifetime of the source target. The former option translates into higher throughput as higher X-ray source power results in quicker measurement exposure times or improved feature detectability as smaller spot sizes results in smaller features being distinguishable. The latter option results in lower operational (variable) expenses for the end user as targets or tubes (in the case where the target is an integral part of the tube) will be replaced at a lower frequency.

The present disclosure describes a variety of configurations of a multi-layer source having multiple target layers (i.e., multiple layers containing continuous or discontinuous regions of X-ray generating materials) and multiple thermal-conduction layers. In certain of these configurations, the regions of X-ray generating materials within a given layer may be formed as plugs, rings, or other limited extent structures relative to an overall cross-section of the source structure. Further, the regions of X-ray generating materials in different layers may be provided in different or complementary configurations so as to reduce the respective areas to which temperature-related stress applies, thereby reducing the effective delamination forces affecting such areas.

X-ray sources as discussed herein may be based on a stationary (i.e., non-rotating) anode structure or a rotating anode structure and may be configured for either reflective or transmissive X-ray generation. As used herein, a transmission-type arrangement is one in which the X-ray beam is emitted from a surface of the source target opposite the surface that is subjected to the electron beam. Conversely, in a reflection arrangement, the angle at which X-rays leave the source target is typically acutely angled relative to the perpendicular to the source target. This effectively increases the X-ray density in the output beam, while allowing a much larger thermal spot on the source target, thereby decreasing the thermal loading of the target.

By way of an initial example, in one implementation an electron beam passes through the relatively transparent thermally conductive layer (e.g., a diamond layer) and is preferentially absorbed by two or more X-ray generating (e.g., tungsten) layers or regions. After being absorbed in the X-ray generating regions, X-ray photons and heat are produced. The majority of the absorbed energy is translated into heat. The surrounding thermally-conductive material carries away the heat much more effectively than X-ray generating material. This reduces the heat concentration within the multilayered structure. Since the maximum temperature within the X-ray generating material is reduced, the power of the electron beam (and the corresponding X-ray generation) can be increased or the spot size can be reduced versus a conventional design without melting the X-ray generating region. The increase in power results in faster sample inspection or longer life. The reduction in spot size results in smaller feature detectability.

With the preceding in mind, and referring to FIG. 1, an X-ray imaging system 10 is shown as including an X-ray source 14 that projects a beam of X-rays 16 through a subject 18 (e.g., a patient or an item undergoing security or quality control inspection). It should be noted that while the imaging system 10 may be discussed in certain contexts, the X-ray imaging systems disclosed herein may be used in conjunction with any suitable type of imaging context or any other X-ray implementation. For example, the system 10 may be part of a fluoroscopy system, a mammography system, an angiography system, a standard radiographic imaging system, a tomosynthesis or C-arm system, a computed tomography system, and/or a radiation therapy treatment system. Further, the system 10 may not only be applicable to medical imaging contexts, but also to various inspection systems for industrial or manufacturing quality control, luggage and/or package inspection, and so on. Accordingly, the subject 18 may be a laboratory sample, (e.g., tissue from a biopsy), a patient, luggage, cargo, manufactured parts, nuclear fuel, or other material of interest.

The subject may, for example, attenuate or refract the incident X rays 16 and produce the projected X-ray radiation 20 that impacts a detector 22, which is coupled to a data acquisition system 24. It should be noted that the detector 22, while depicted as a single unit, may include one or more detecting units operating independently or in conjunction with one another. The detector 22 senses the projected X-rays 20 that pass through or off of the subject 18, and generates data representative of the radiation 20. The data acquisition system 24, depending on the nature of the data generated at the detector 22, converts the data to digital signals for subsequent processing. Depending on the application, each detector 22 produces an electrical signal that may represent the intensity and/or phase of each projected X-ray beam 20.

An X-ray controller 26 may govern the operation of the X-ray source 14 and/or the data acquisition system 24. The controller 26 may provide power and timing signals to the X-ray source 14 to control the flux of the X-ray radiation 16, and to control or coordinate with the operation of other system features, such as cooling systems for the X-ray source, image analysis hardware, and so on. In embodiments where the system 10 is an imaging system, an image reconstructor 28 (e.g., hardware configured for reconstruction) may receive sampled and digitized X-ray data from the data acquisition system 24 and perform high-speed reconstruction to generate one or more images representative of different attenuation, differential refraction, or a combination thereof, of the subject 18. The images are applied as an input to a processor-based computer 30 that stores the image in a mass storage device 32.

The computer 30 also receives commands and scanning parameters from an operator via a console 34 that has some form of operator interface, such as a keyboard, mouse, voice activated controller, or any other suitable input apparatus. An associated display 40 allows the operator to observe images and other data from the computer 30. The computer 30 uses the operator-supplied commands and parameters to provide control signals and information to the data acquisition system 24 and the X-ray controller 26.

Figure 2:
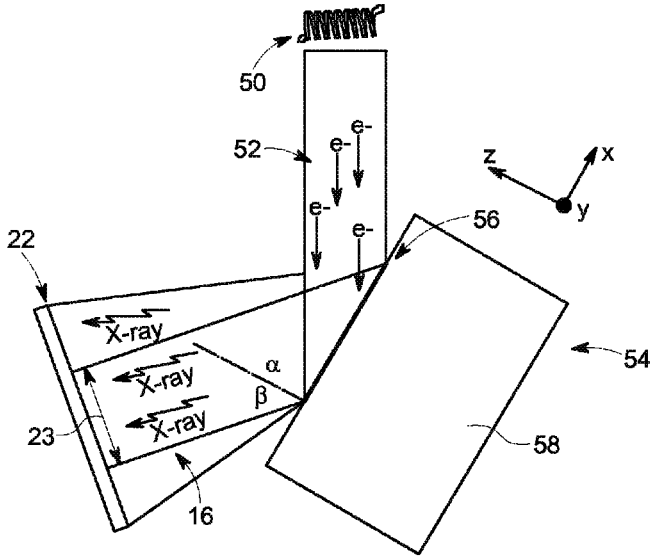
FIG. 2 depicts a generalized view of the incident electron beam as it relates to the thermal spot on the target surface and the optical spot seen by the detector, in accordance with aspects of the present disclosure.

Referring now to FIG. 2, a high level view of components of an X-ray source 14, along with detector 22, are depicted. The aspects of X-ray generation shown are consistent with a reflective X-ray generation arrangement that may be consistent with either a rotating or stationary anode X-ray source 14. In the depicted implementation, an X-ray source 14 includes an electron beam emitter (here depicted as an emitter coil 50) that emits an electron beam 52 toward a target region of X-ray generating material 56. The X-ray generating material may be a high-Z material, such as tungsten, molybdenum, titanium-zirconium-molybdenum alloy (TZM), tungsten-rhenium alloy, or any other material or combinations of materials capable of emitting X-rays when bombarded with electrons) The source target may also include one or more thermally-conductive materials, such as substrate 58, or thermally conductive layers or other regions surrounding the X-ray generating material. As used herein, a region of X-ray generating material 56 is generally described as being encompassed by a target layer or X-ray generating layer of the source target, where the X-ray generating layer has some corresponding thickness, which may vary for different X-ray generating layers within a given source target.

The electron beam 52 incident on the X-ray generating material 56 generates X-rays 16 that are directed toward the detector 22 and which are incident on the detector 22, the optical spot 23 being the area of the focal spot projected onto the detector plane. The electron impact area on the X-ray generating material 56 may define a particular shape, thickness, or aspect ratio on the source target (i.e., anode 54) to achieve particular characteristics of the emitted X-rays 16. For example, the emitted X-ray beam 16 may have a particular size and shape that is related to the size and shape of the electron beam 52 when incident on the X-ray generating material 56. Accordingly, the X-ray beam 16 exits the source target 54 from an X-ray emission area that may be predicted based on the size and shape of the impact area. In the depicted example the angle between the electron beam 52 and the normal to the target is defined as $\alpha$. The angle $\beta$ is the angle between the normal of the detector and the normal to the target. Where b is the thermal focal spot size at the target region 56 and c is optical focal spot size, $b=c/\cos\beta$. Further, in this arrangement, the equivalent target angle is $90-\beta$.

As discussed in greater detail below, various embodiments, employ a multi-target layer source target 54 having two or more layers or regions of X-ray generating material 56 in the z-dimension that are separated by thermally conductive material (including top layers, intervening layers, and/or substrates). Such a multi-layer source target 54 (e.g. anode) (including the respective layers and/or intra-layer structures and features discussed herein) may be fabricated using any suitable technique, such as suitable semiconductor manufacturing techniques including vapor deposition (such as chemical vapor deposition (CVD)), sputtering, atomic layer deposition, chemical plating, ion implantation, or additive or reductive manufacturing, and so on.

Referring to FIG. 2, generally the thermally conductive materials, whether provided within the same layer as the X-ray generating materials or in different layers, have thermal conductivities that are higher than those exhibited by the X-ray generating target material. By way of non-limiting example, a thermal-conducting layer 58 may include carbon-based materials including but not limited to highly ordered pyrolytic graphite (HOPG), diamond, and/or metal-based materials such as beryllium oxide, silicon carbide, copper-molybdenum, oxygen-free high thermal conductivity copper (OFHC), or any combination thereof. Alloyed materials such as silver-diamond may also be used. Table 1 below provides the composition, thermal conductivity, coefficient of thermal expansion (CTE), density, and melting point of several such materials.

TABLE 1

| Material | Composition | Thermal Conductivity W/m-K | CTE ppm/K (@ Room Temp) | Density g/cm$^3$ | Melting point ° C. |
|---|---|---|---|---|---|
| Diamond | Polycrystal-line diamond | 1200 | 1.5 | 3.5 | 3550 |
| Beryllium oxide | BeO | 250 | 7.5 | 2.9 | 2578 |
| CVD SiC | SiC | 250 | 2.4 | 3.2 | 2830 |
| Highly oriented pyrolytic graphite | C | 1700 | 0.5 | 2.25 | NA |
| Cu—Mo | Cu—Mo | 400 | 7 | 9-10 | 1100 |
| Ag-Diamond | Ag-Diamond | 650 | <6 | 6-6.2 | 961-3550 |
| OFHC | Cu | 390 | 17 | 8.9 | 1350 |

It should be noted that the different thermally-conductive layers, structures, or regions within an source target 54 may have correspondingly different thermally-conductive compositions, different thicknesses, and/or may be fabricated differently from one another, depending on the respective thermal conduction needs at a given region within the source target 54. However, even when differently composed, such regions, if formed so as to conduct heat from the X-ray generating materials 54, still constitute thermally-conductive layers (or regions) as used herein. Further, as discussed herein, in various embodiments respective depth (in the z-dimension) within the source target 54 may determine the thickness of X-ray generating material found at that depth, such as to accommodate the electron beam incident energy expected at that depth. That is, layer or regions of X-ray generating material formed at different depths within a source target 54 may be formed so as to have different thicknesses.

In certain embodiments, the X-ray generating material 56 found within a given layer of the source target 54 may be provided over a limited extent relative to the effective surface area of the source target 54 when viewed in cross-section in a given x,y, plane, e.g., as a discrete "plug" or a "ring" within a respective layer formed in the x,y plane. In particular, studies performed in support of the present document have shown that limiting the active X-ray producing (but low thermal conductivity material) region(s) 56 to the size of the electron beam 52 (i.e., a plug) can allow an increase in the maximum power. In such an arrangement, heat transfer may be facilitated away from the limited area X-ray generating regions 56 by thermally-conductive layers not only above and below the X-ray generating materials 56, but also by thermally-conductive material disposed laterally (i.e., within the same layer.

Figure 3:
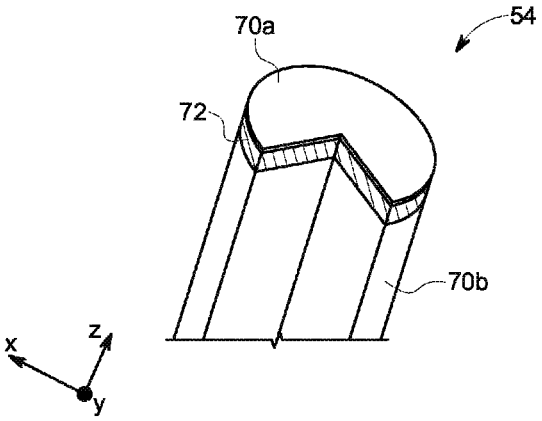
FIG. 3 depicts cut-away perspective view of an X-ray source having a continuous target layer, in accordance with aspects of the present disclosure.

By way of example of these concepts, FIG. 3 depicts a partial-cutaway perspective view of a stationary X-ray source target (i.e., anode) 54 having alternating layers, in the z-dimension, of: (1) a first thermally-conductive layer **70*a* (such as a thin diamond film, approximately 4 μm in thickness) on face of the source target 54 to be impacted by the electron beam 52; (2) an X-ray generating layer 72 of X-ray generating material 56 (i.e., a high-Z material, such as a tungsten layer approximately 40 μm in thickness); and (3) a second thermally-conductive layer 70*b* (such as a diamond layer or substrate approximately 1.5 mm in thickness) underlying the X-ray generating layer 72. In the depicted example, which is shown to provide useful context for the examples to follow, the X-ray generating material within the X-ray generating layer 72 is continuous throughout the layer 72, i.e., is not of limited extent with respect to the cross-sectional area in an x,y plane of the source target 54. Further, the example of FIG. 3 depicts only a single X-ray generating layer 72, though the single X-ray generating layer is part of a multi-layer source target 54 in that the X-ray generating layer 72 is sandwiched between two thermal-conduction layers 70*a* and 70*b*. The source target 54 configuration shown in FIG. 3 has a calculated maximum power that is twice (2×) that of a baseline value associated with a solid tungsten disk under certain conditions. By way of example, in one embodiment, the baseline maximum power for a solid tungsten layer is 25 W while the calculated maximum power for the multilayer configuration shown in FIG. 3** is 50 W when exposed to a 25 μm diameter, 300 keV electron beam.

Figure 4:
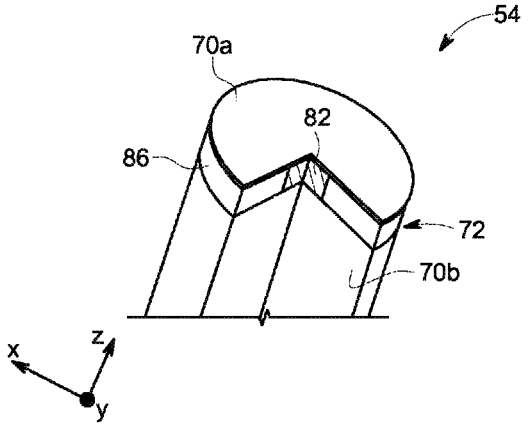
FIG. 4 depicts cut-away perspective view of an X-ray source having a discontinuous target layer, in accordance with aspects of the present disclosure.

Turning to FIG. 4, a partial-cutaway perspective view is provided of a stationary X-ray source target (i.e., anode) 54 having an X-ray generating layer 72 in which the X-ray generating material 56 is not continuous across the cross-sectional extent in an x,y plane of the source target 54 but instead forms a "plug" or limited region 82 within the X-ray generating layer 72. In such a configuration, the cross-sectional area of the plug region 82 in the respective x,y plane may be sized so as to correspond to the size of the incident electron beam 52 and, in this manner, increase the allowable maximum power. In practice, the cross-sectional area of the plug 82 may be sized to accommodate uncertainty in the relative position of the electron beam spot and the target. In this example, the lateral sides of the plug 82 of target material 56 are also proximate or laterally adjacent thermally conductive material 86 (e.g., diamond) within the X-ray generating layer 72 such that heat may be removed from the plug 82 of X-ray generating material 56 laterally as well as along the electron beam-facing and opposing surfaces.

With respect to a plug-type embodiment as shown in FIG. 4, various embodiments are contemplated. In one embodiment, for example, the cross-sectional area of the plug 82 may be smaller than the incident electron beam so as to control the size of the optical spot 23 (FIG. 2). In such an embodiment, (i.e., a "big" electron beam 52 focal spot relative to a "small" plug 82, only one effective focal spot size is possible as it is defined by the size of the plug 82, with electron beam 52 not incident on the plug 82 (i.e., outside the plug area) being incident on the surrounding X-ray transparent, thermally conductive material. Such an embodiment may provide a sharp, repeatable, X-ray generating volume.

Conversely, in another embodiment the plug 82 may be sized to be bigger than the incident electron beam 52 (i.e., a "big" plug 82 relative to a "small" electron beam 52 focal spot). In such an embodiment, the electron beam focal spot size only needs to be big enough to account for position tolerance of the electron beam 52 and target area. Such an embodiment may provide focal spot size flexibility (as the electron beam 52 may be varied to be the cross-sectional size of the plug 82 or less), but with a trade-off in heat spreading to the extent that the electron beam size is less than the size of the plug 82.

It may also be noted that the placement of the plug 82 relative to the central axis of the source target 54 may vary. For example, the plug 82 may be centered about a central-axis of the source target 54, as shown. Alternatively, the plug 82 may be off-center with respect to the central axis of the source target 54. In general, placement of the plug 82 within a given X-ray generating layer 72 of the source target 54 will be determined on where the electron beam 52 will hit that layer of the source target 54. That is, the plug 82 will generally be positioned to coincide with the incident electron beam 52.

With respect to the example shown in FIG. 4, dimensions and thickness of layers are generally comparable to the preceding example except, instead of a continuous layer 72 of X-ray generating material, the extent of the X-ray generating material within the layer is limited to less than the full cross-sectional extent of the layer 72. In one implementation, the X-ray generating layer may be 30 μm-40 μm thick, with a tungsten plug 82 embedded in a surrounding diamond matrix 86. The cross-sectional shape and size of the plug 82 is determined based on the shape and size of the incident electron beam 52 on the X-ray generating layer, as discussed above, when in operation. Though the example of FIG. 4 shows a circular cross-sectional shape for the plug 82 in the respective x,y plane, it should be appreciated that the plug 82 may have other cross-sectional shapes (e.g., elliptical, square, rectangular, and so forth) based on the shaping and/or focusing applied to the electron beam 52.

With this in mind, one example of a suitable multi-layer source target 54 may include: (1) a first thermally-conductive layer **70*a* (such as a thin diamond film, approximately 1-6 μm in thickness) on a face of the source target 54 to be impacted by the electron beam 52; (2) a dis-continuous X-ray generating layer 72 approximately 20-40 μm in thickness, such as a plug 82 of tungsten on which the electron beam 52 is directed surrounded by a diamond matrix 86; and (3) a second thermally-conductive layer 70*b* (such as a diamond layer or substrate approximately 1.5 mm in thickness) underlying the X-ray generating layer 72. The source target 54 configuration shown in FIG. 4 has a calculated maximum power that is three-times (3×) that of a baseline, solid tungsten disk under certain conditions. By way of example, in one embodiment, the baseline maximum power for a solid tungsten layer is 25 W while the calculated maximum power for the multilayer, plug configuration shown in FIG. 4** is 75 W when exposed to a 25 μm diameter 300 kV electron beam.

It should be appreciated that, both in the preceding and the following discussions, the X-ray generating material 56 portions of an X-ray generating layer 72 may be provided in a variety of forms, including as a solid or uniform sheet or layer of X-ray generating material 56. However, in other embodiments the deposition of the X-ray generating material 56 may not be uniform but may instead be graded (i.e., a gradient transition) such that a X-ray generating material 56 gradually transitions in the z-dimension (or other dimensions) from a region of no X-ray generating-material 56 to a region of substantially all X-ray generating material 56. That is, the regions of X-ray generating material 56 may not be defined by a sharp or absolute transition or boundary, but may instead be defined by a gradual transition. Such gradual transitions may be structurally desirable from a stress mitigation standpoint. Similarly, in certain other embodiments the X-ray generating material 56 present in an X-ray generating layer 72 may be provided not as a solid film or layer, but as particulates or particles of the X-ray generating material 56 embedded (e.g., implanted ions, atoms, or molecules) within a matrix or non-matrix substrate. Such implementations may also be useful from a stress mitigation or heat dissipation standpoint. Thus, discussions of regions or layers of X-ray generating material 56 as used herein should be understood to not only encompass solid and/or discrete bounded regions of X-ray generating material 56, but also potentially regions of X-ray generating material 56 having graded or gradual transitions boundaries and/or regions of X-ray generating material 56 comprising embedded particles of X-ray generating material 56.

Figure 5:
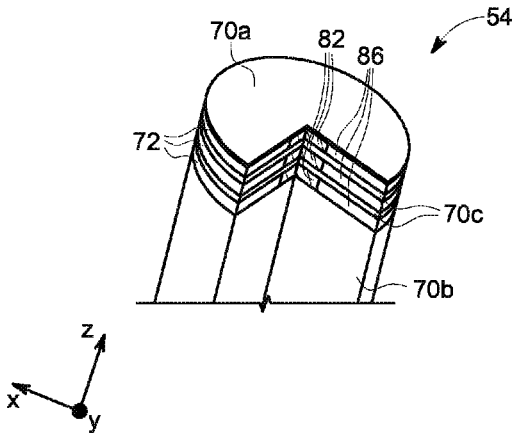
FIG. 5 depicts cut-away perspective view of an X-ray source having a discontinuous multi-layer target, in accordance with aspects of the present disclosure.

Turning to FIG. 5, a partial-cutaway perspective view is provided of a stationary X-ray source target 54 having multiple X-ray generating layers 72 in the z-dimension. As with the example of FIG. 4, the X-ray generating material in each X-ray generating layer 80 not continuous across the cross-sectional extent in an x,y plane of the source target 54 but instead forms a "plug" or limited region 82 within the X-ray generating layer 72. As with the example of FIG. 4, the embodiment shown in FIG. 5 includes, within each X-ray generating layer 72, lateral sides (i.e., within the respective x,y planes) of the plugs 82 that are proximate or laterally adjacent thermally conductive material 86 (e.g., diamond) within the respective X-ray generating layer 72 such that heat may be removed from the X-ray generating materials forming the plugs 82 laterally (i.e., in the x and y directions) as well as along the electron beam-facing and opposing surfaces (i.e., in the z-direction). As discussed in the preceding example, one or more of the plugs 82 may be off-center with respect to a central axis of the source target 54, depending on the intended incidence of the electron beam with respect to a given plug 82.

As with the preceding example, the cross-section area in the x,y plane of the plug regions 82 may be sized so as to correspond to the size of the incident electron beam 52 at the respective plane and, in this manner, increase the allowable maximum power. Further, as discussed with respect to FIG. 4, a given plug 82 may be sized so as to correspond to the electron beam spot, to be smaller than the electron beam spot, or to be larger than the electron beam spot, depending on the implementation. As will be appreciated, therefore, the cross-sectional area of each plug 82 may vary in the different X-ray generating layers 72 to accommodate different incidence of the electron beam 52 at a given layer 72 (i.e., X-ray generating layers 72 farther from the surface 70*a* may have plugs 82 having greater cross-sectional area to accommodate spread of the electron beam). The cross-sectional shape of the respective plugs 82 in the x, y dimension may be any suitable geometric shape, including, but not limited to, circular, square, elliptical, or rectangular (such as for use with high-aspect ratio electron bean shapes). Further, the thickness of the different plugs 82 (and associated X-ray generating layers 72) may vary (e.g., increase) with increasing depth (in the z-dimension) relative to the surface of the source target 54, such as to account for the drop in energy at greater distances from the initial target surface (i.e., first thermally-conductive layer 70*a*).

With respect to the example shown in FIG. 5, dimensions and thickness of layers are generally comparable to the preceding example except, instead of a 30 μm-40 μm thick plug 82 and corresponding X-ray generating layer 72, the multiple X-ray generating layers 72 and corresponding plugs 82 of FIG. 5 are respectively thinner. For example, in one embodiment each X-ray generating layer 72 and corresponding plug 82 is approximately 13 μm thick (such as 13 μm thick plugs of X-ray generating material), such that the aggregate thickness of the X-ray generating layers 72 is approximately 40 μm. As noted above, however, in certain embodiments, the thickness of the plugs 82 (and corresponding X-ray generating layers 72) may vary with the depth of a respective layer 72 within the source target 54, such as thicker X-ray generating layers 72 corresponding to deeper depths.

With this in mind, one example of a suitable multi-layer source target 54 may include: (1) a first thermally-conductive layer 70*a* (such as a thin diamond film, approximately 1-6 μm in thickness) on the face of the source target 54 to be impacted by the electron beam 52; (2) first, second, and third target-ray generating layers 72, each approximately 9-14 μm in thickness and having a plug 82 of X-ray generating material (e.g., tungsten) on which the electron beam 52 is directed surrounded by a thermally conductive material 86 (e.g., a diamond matrix); (3) a second thermally-conductive layer 70*b* (such as a diamond layer or substrate approximately 1.5 mm in thickness) underlying the bottom-most X-ray generating layer 72; (4) intervening thermal-conduction layers 70*c* disposed between the X-ray generating layers 72. The source target (i.e., anode) 54 configuration shown in FIG. 5 has a calculated maximum power that is more than five-times (5×) that of a baseline, solid tungsten disk under certain conditions. By way of example, in one embodiment, the baseline maximum power for a solid tungsten layer is 25 W while the calculated maximum power for the multilayer, plug configuration shown in FIG. 5 is 132 W when exposed to a 25 μm diameter 300 kV electron beam.

While the preceding describe generalized source target structures and calculated powers, Table 2 (below) and FIG. 6 convey additional information about different variations of target-ray generating layers, multiple X-ray generating layer arrangements, and multiple thermally-conductive layer arrangements for a given temperature limit. The data shown in Table 2 and FIG. 6 corresponds to the use of a 25 μm electron beam focal spot and system potential of 300 kV, with the target being a stationary reflection source target.

TABLE 2

| Calculated Max Power | | | | | | | |
|---|---|---|---|---|---|---|---|
| Design | Multilayer Configuration | Di Top Layer | Rel. Max Power (W) | Subs. (mm) | $T_W$ (C.) | $T_{W\text{-}to\text{-}Sub}$ (C.) | $T_{Di\text{-}to\text{-}W}$ (C.) |
| 0 | W-W | No | 1 | 1.5 | 1964 | N/A | N/A |
| 1 | W-W | No | 1.3 | 1.5 | 2503* | N/A | N/A |
| 2 | W-Cu | No | 0.7 | 1.5 | 1393 | 713* | N/A |
| 3 | W-HOPG | No | 1.6 | 1.5 | 2501* | 815 | N/A |
| 4 | W-Di | No | 1.6 | 1.5 | 2489* | 692 | N/A |
| 5a | Di-W | 2 μm | 1.2 | 1.5 | 2168 | N/A | 1507* |
| 5b | Di-W | 4 μm | 1.5 | 1.5 | 2515* | N/A | 1503* |
| 5c | Di-W | 6 μm | 1.6 | 1.5 | 2498* | N/A | 1388 |
| 6 | Di-W-Di | 4 μm | 2 | 1.5 | 2492* | 738 | 1329 |
| 7 | Di-W-Di (plug) | 4 μm | 3 | 1.5 | — | — | — |
| 8 | Di-W-Di-W-Di | 4 μm | 3.4 | 1.5 | 2498* | 767 | 1303 |
| 9 | Di-(W-Di) × 3 | 4 μm | 4.3 | 1.5 | 2492* | 805 | 1415 |
| 10 | Di-(W(plug)-Di) × 3 | 4 μm | 5.3 | 1.5 | — | — | — |

Figure 6:
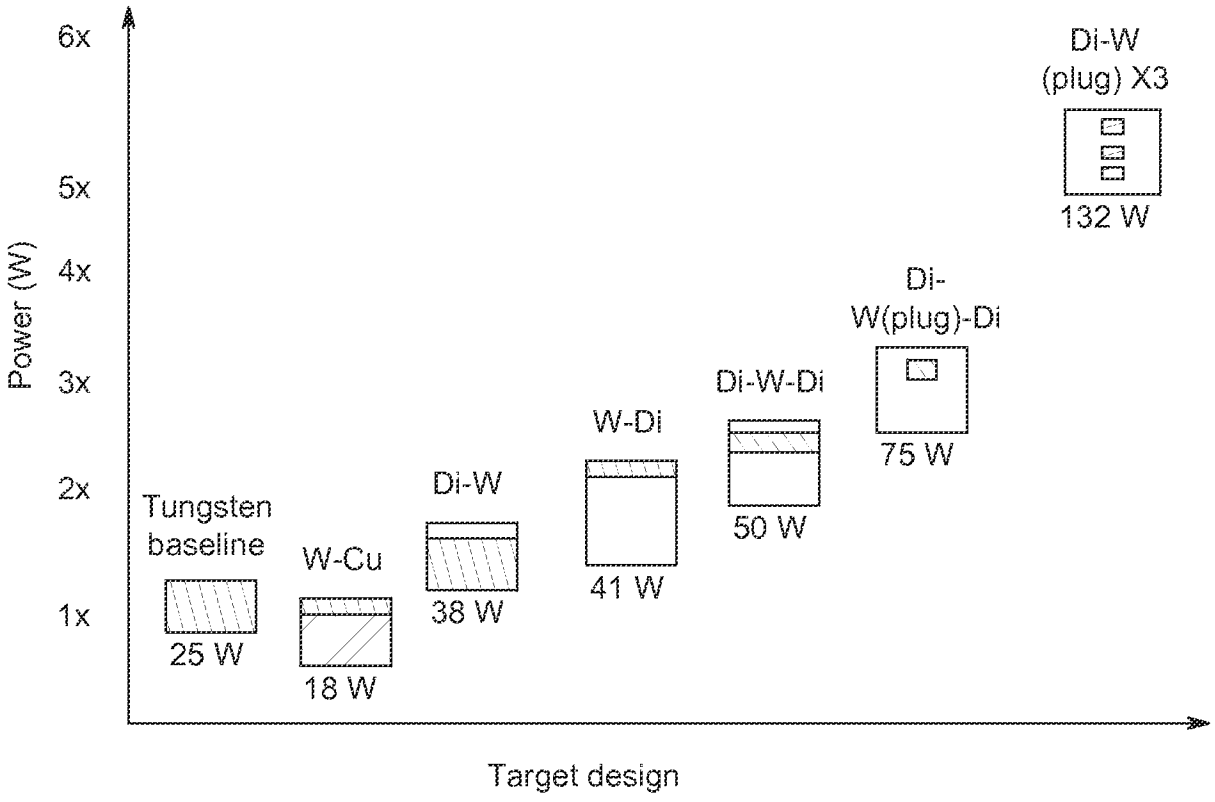
FIG. 6 graphically depicts power versus target design, in accordance with aspects of the present disclosure.

With respect to Table 2 and FIG. 6, W refers to tungsten, Di to diamond, HOPG to highly ordered pyrolitic graphite, "Subs (mm)" refers to the thickness of the substrate in mm, "Rel. Max Power" refers to the maximum power relative to the baseline case defined as design 0, and temperatures denoted with a "*" represent limit temperatures. Certain of the information from Table 2 is graphically depicted in FIG. 6, where the respective stationary reflection designs 0, 2, 5b, 4, 6, 7, and 10 are graphically depicted (from left to right), and plotted with their calculated powers relative to a baseline, solid tungsten disk.

With the preceding discussion in mind, certain specific arrangements of target regions and layers within an X-ray source 14 are provided as additional examples and to further illustrate certain concepts. For example, FIGS. 7-13 each illustrate top-down and cross-sectional views (i.e., in a respective x,y plane) of multi-layer source targets 54 having X-ray generating layers 72 in which the X-ray generating materials do not extend fully across the surface of the source target 54 and which are interleaved with thermally conductive layers 70. In particular, the present implementations are believed to offer benefits in terms of mitigation of high-stress and/or prevention or reduction of delamination occurrences in the context of thin film multi-layer X-ray source targets 54.

Figure 7A:
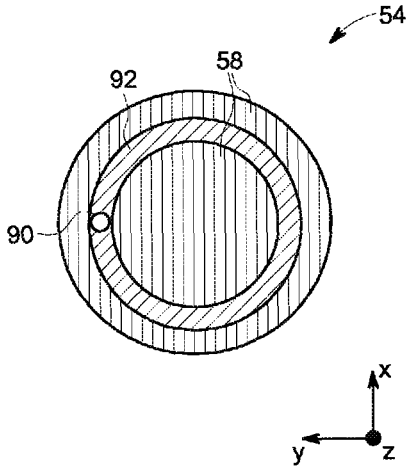
FIG. 7A depicts a top-down view of ring-shaped target region, in accordance with aspects of the present disclosure.
Figure 7B:
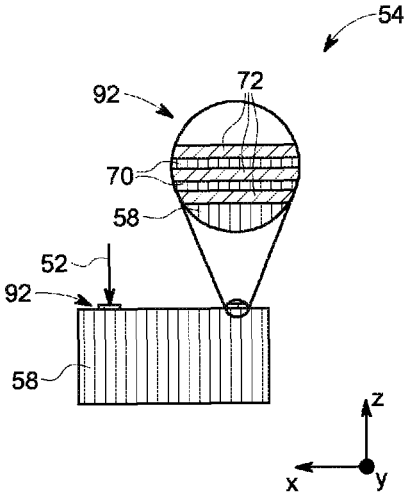
FIG. 7B depicts a cross-sectional side-view of one implementation of the target layer of FIG. 7A, in accordance with aspects of the present disclosure

With this in mind, in the implementation of FIGS. 7A and 7B, a multi-layer structure 92 (see inset) is formed on a thermally conductive substrate 58. In the depicted example, the multi-layer structure 92 is formed as a ring having three X-ray generating layers 72 provided at different depths (though other numbers of X-ray generating layers may be provided) and separated by intervening thermally conductive layers 70. In an embodiment such as shown in FIGS. 7A and 7B, heat generated by the electron beam interaction with the X-ray generating layers 72 may be conducted away by the adjacent thermally-conductive layers 70.

The X-ray generating layers 72 (i.e., the layers having X-ray generating material 56) do not extend across the full surface of the source target 54, but are instead limited to the depicted ring. In one embodiment, the X-ray generating layers 72 may be rings of tungsten deposited where the electron-beam 52 will impact the source target 54 (as shown by focal spot 90 in FIG. 7A), with the size and shape of the tungsten regions (i.e., the X-ray generating layers 72) being controlled by masking applied during the deposition process, by etching performed after the deposition process, or by other additive or reductive fabrication technologies. In one embodiment, the ring-shaped multi-layer structure 92 has an inner diameter of 6 mm and an outer diameter of 9 mm, while the total diameter of the source target 54 is 9.5 mm. This particular design is intended to accommodate a thermal spot whose maximum dimension is 0.5 mm that hits the target at a radial position of 7.5 mm.

Figure 8A:
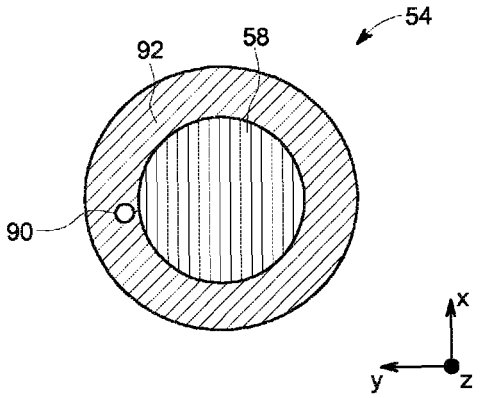
FIG. 8A depicts a top-down view of an alternative implementation of a ring-shaped target region, in accordance with aspects of the present disclosure.
Figure 8B:
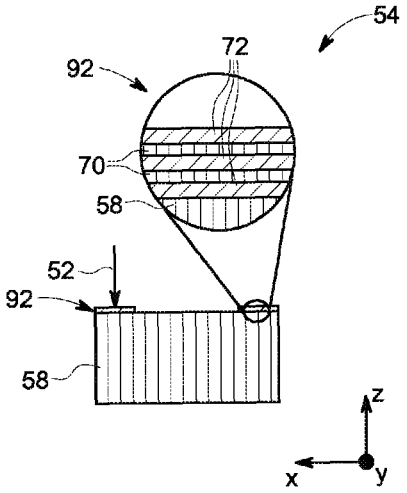
FIG. 8B depicts a cross-sectional side-view of one implementation of the target layer of FIG. 8A, in accordance with aspects of the present disclosure.

Turning to FIGS. 8A and 8B, another ring-shaped multi-layer structure 92 embodiment is shown. In this example, as in the previous, the multi-layer structure 92 is formed on a thermally conductive substrate 58. The multi-layer structure 92 is formed as a ring that extends to the periphery of the source target 54, but which does not extend inward beyond the inner boundary of the ring. The multi-layer structure 92 has three X-ray generating layers 72 provided at different depths (though other numbers of X-ray generating layers may be provided) and separated by intervening thermally conductive layers 70. As in other examples, heat generated by the electron beam interaction with the X-ray generating layers 72 may be conducted away by the adjacent thermally-conductive layers 70.

The X-ray generating layers 72 (i.e., the layers having X-ray generating material 56) do not extend across the full surface of the source target 54, but are instead limited to the depicted ring. As in the preceding example, the X-ray generating layers 72 may be rings of tungsten deposited where the electron-beam 52 will impact the source target 54 (as shown by focal spot 90 in FIG. 8A), with the size and shape of the tungsten regions (i.e., the X-ray generating layers 72) being controlled by masking applied during the deposition process, by etching performed after the deposition process, or by other additive or reductive fabrication technologies. In one embodiment, the ring-shaped multi-layer structure 92 has an inner diameter of 6 mm and an outer diameter of 9.5 mm. This particular design is intended to accommodate a thermal spot whose maximum dimension is 0.5 mm that hits the target at a radial position of 7.5 mm. It should be appreciated that though FIGS. 7 and 8 each depict multi-layer structures in ring configurations, various other geometric shapes are contemplated, such as ellipses, squares, and/or rectangles that are hollow in cross-section or "filled" with a thermally conductive material. As noted above, the X-ray generating layers 72 are generally sized and/or shaped to correspond to the possible positions of the electron beam incidence on the source target 54.

Figure 9A:
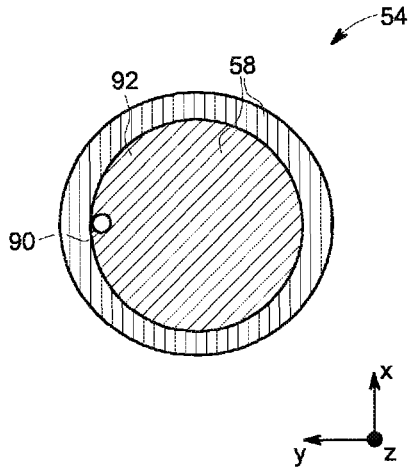
FIG. 9A depicts a top-down view of an alternative implementation of a ring-shaped target region, in accordance with aspects of the present disclosure.
Figure 9B:
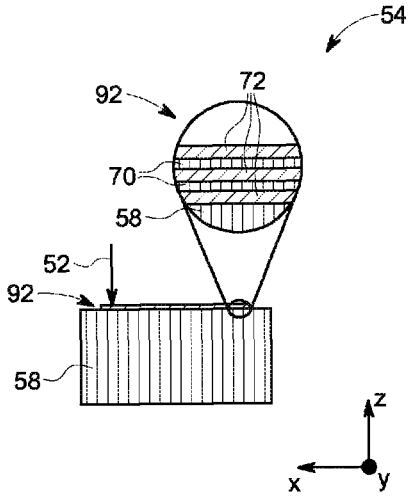
FIG. 9B depicts a cross-sectional side-view of one implementation of the target layer of FIG. 9A, in accordance with aspects of the present disclosure.

FIGS. 9A and 9B depict a further multi-layer structure 92 embodiment. In this example, the multi-layer structure 92 is formed on a thermally conductive substrate 58 as a circular region (though other geometries may be employed instead) which does not extend across the full extent of the substrate 58. The depicted multi-layer structure 92 has three X-ray generating layers 72 provided at different depths (though other numbers of X-ray generating layers may be provided) and separated by intervening thermally conductive layers 70. As in other examples, heat generated by the electron beam interaction with the X-ray generating layers 72 may be conducted away by the adjacent thermally-conductive layers 70.

The X-ray generating layers 72 (i.e., the layers having X-ray generating material 56) do not extend across the full surface of the source target 54, but are instead limited to the depicted circular geometry. As in the preceding example, the X-ray generating layers 72 may be layers of tungsten deposited where the electron-beam 52 will impact the source target 54 (as shown by focal spot 90 in FIG. 9A), with the size and shape of the tungsten regions (i.e., the X-ray generating layers 72) being controlled by masking applied during the deposition process, by etching performed after the deposition process, or by other additive or reductive fabrication technologies. As noted above, the X-ray generating layers 72 are generally sized and/or shaped to correspond to the possible positions of the electron beam incidence on the source target 54.

While the preceding examples relate various ring-shaped arrangements of a multi-layer structure, it should be appreciated that other arrangements are also possible. By way of example, FIGS. 10-13 depict multi-layer structures 92 in which the multi-layer structures 92 are cut or etched to provide strain relief in various patterns. It should be appreciated that such arrangements and patterns of cuts or etches are provided by way of illustration and example only, and are not intended to be an exhaustive list or description of possible patterns encompassed by the present discussion. Further, to the extent that benefits or utility of certain configurations is evident in the discussion of preceding examples, such benefits and utility may not be repeated or discussed only in brief, with comments instead emphasizing new and different aspects of the depicted configurations not previously shown.

Figure 10A:
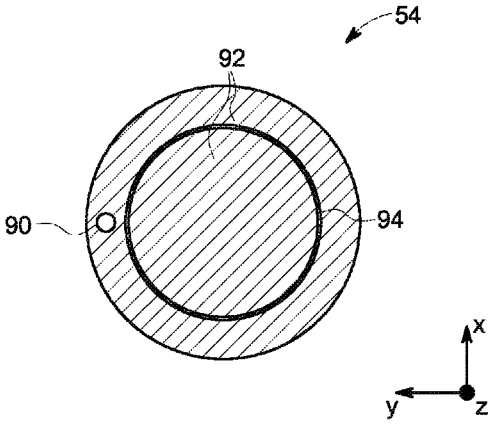
FIG. 10A depicts a top-down view of a target region including additional elevational structural features, in accordance with aspects of the present disclosure.
Figure 10B:
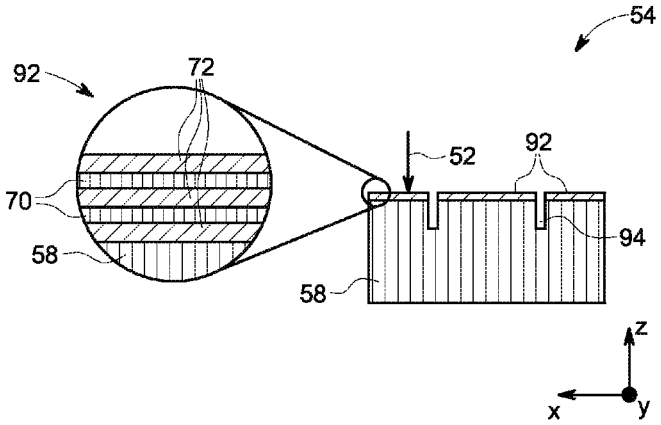
FIG. 10B depicts a cross-sectional side-view of one implementation of the target layer of FIG. 10A, in accordance with aspects of the present disclosure.
Figure 11A:
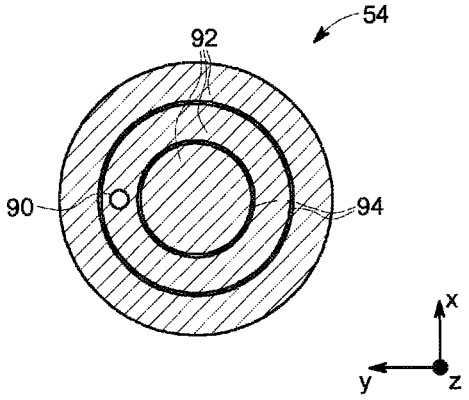
FIG. 11A depicts a top-down view of a target region including other elevational structural features, in accordance with aspects of the present disclosure.
Figure 11B:
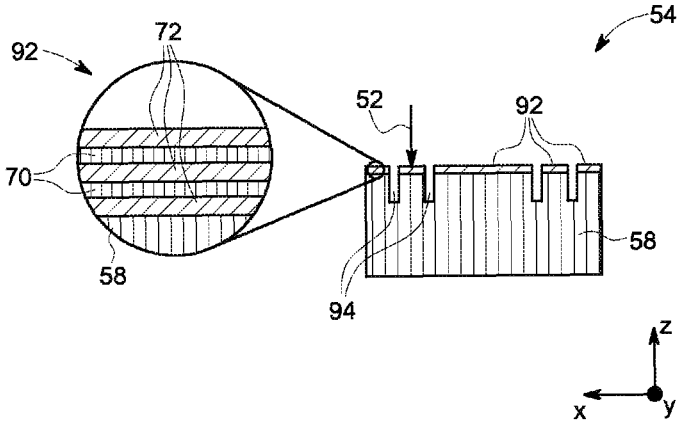
FIG. 11B depicts a cross-sectional side-view of one implementation of the target layer of FIG. 11A, in accordance with aspects of the present disclosure.

Turning to the figures, FIGS. 10A and 10B depict a source target 54 having a multi-layer structure 92 as previously described in which the multi-layer structure 92 is etched, or deposited on an etched substrate 58, such that the etched or cut regions (e.g., ring-shaped trenches 94 in FIGS. 10A and 10B) break up the continuity of the multi-layer structure 92. In this arrangement, the discontinuity introduced by the trenches in the multi-layer structure 92 may reduce thermal stress and/or delamination of the multi-layer structure 92. Turning to FIGS. 11A and 11B, these figures depict a similar "ring or circle cut" arrangement but with two nested ring trenches 94 formed in the multi-layer structure 92. As in FIGS. 10A an 10B, such an arrangement may provide thermal stress relief and prevent delamination and may be fabricated using the same types of technologies.

In such embodiments, the narrow slots or rings (e.g., trenches 94) formed in the substrate 58 (or the multi-layer structure 92 and/or substrate 58, depending on the fabrication approach), may be formed using suitable surface deposition and etching techniques or other additive and reductive fabrication technologies. For example, such trenches or cuts may be formed in fabrication by masking with thin rings during deposition of the multi-layer structure 92 or by cutting the substrate 58 with energetic beams (e.g., laser scribed). It also may be necessary to cut a trench repeatedly after one or more layers of the multi-layer structure 92 have been deposited. The depicted trenches 94 may, in certain implementations, have widths in the range of 10 μm to 100 μm (e.g., 15 μm). In embodiments employing different ring-shaped trenches 94, the trenches may have different depths and/or widths, for example one trench may be 15 μm wide while the other trench is 100 μm wide.

Figure 12A:
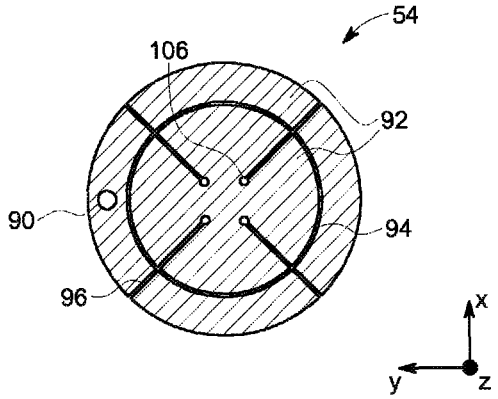
FIG. 12A depicts a top-down view of a target region including additional elevational structural features, in accordance with aspects of the present disclosure.

Turning to FIGS. 12A and B and 13A and B, further implementations are depicted in which radial trenches 96 are formed in addition to the ring shaped trenches 94 shown in FIGS. 10A and 11A. Though shown in the present examples with the ring-shaped trenches 94 of the preceding examples, it should be appreciated that the depicted radial trenches 96 may also be implemented in the absence of ring trenches 94 and may still provide stress mitigation and delamination benefits. As with ring trenches 94, radial trenches 96 may be formed in fabrication by masking with thin strips or lines during deposition of the multi-layer structure 92 or by cutting before or after fabricating the alternating layers of the multi-layer structure 92 with energetic beams (e.g., laser scribe) and may have widths in the range of 10 μm to 100 μm (e.g., 15 μm). It may be necessary to cut the trenches repeatedly after one or more layers of the multi-layer structure 92 have been deposited.

Figure 12B:
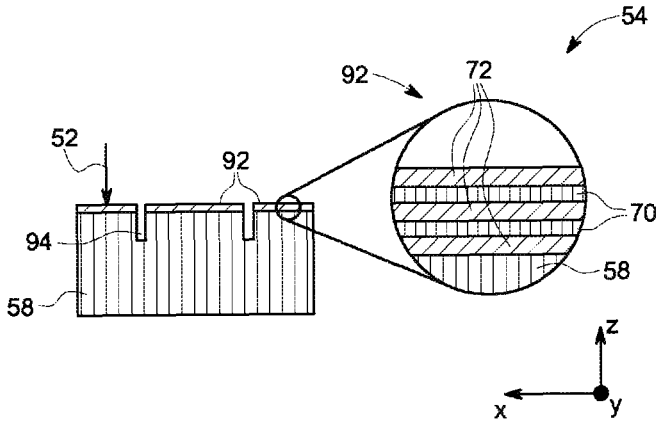
FIG. 12B depicts a cross-sectional side-view of one implementation of the target layer of FIG. 12A, in accordance with aspects of the present disclosure.
Figure 13A:
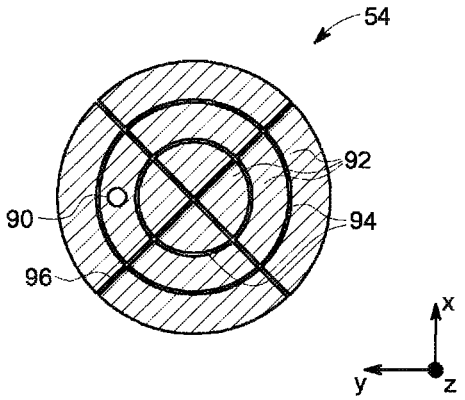
FIG. 13A depicts a top-down view of a target region including additional elevational structural features, in accordance with aspects of the present disclosure.
Figure 13B:
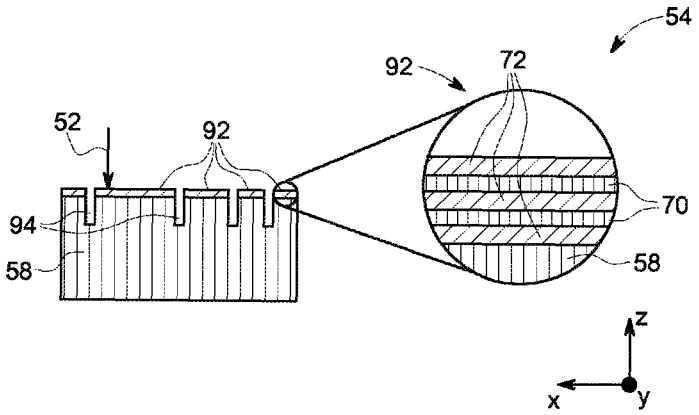
FIG. 13B depicts a cross-sectional side-view of one implementation of the target layer of FIG. 13A, in accordance with aspects of the present disclosure.

The examples shown in FIGS. 12A and B and 13A and B differ in whether the radial trenches 96 extend through the radial center of the source target 54. In the structure of FIGS. 12A and 12B, the trenches 96 do not extend through the radial center of the structure. In the depicted implementation, a strain relief area 106 is provided at the termination of the radial trenches 96 to provide additional stress relief.

Figure 14A:
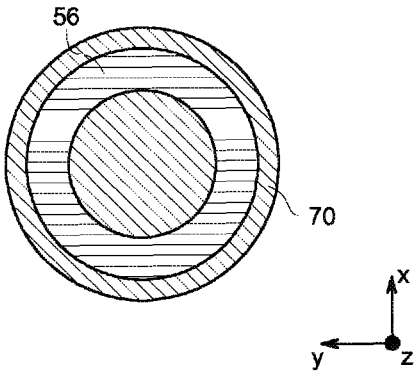
FIG. 14A depicts a top-down view of a target region including further elevational structural features, in accordance with aspects of the present disclosure.
Figure 14B:
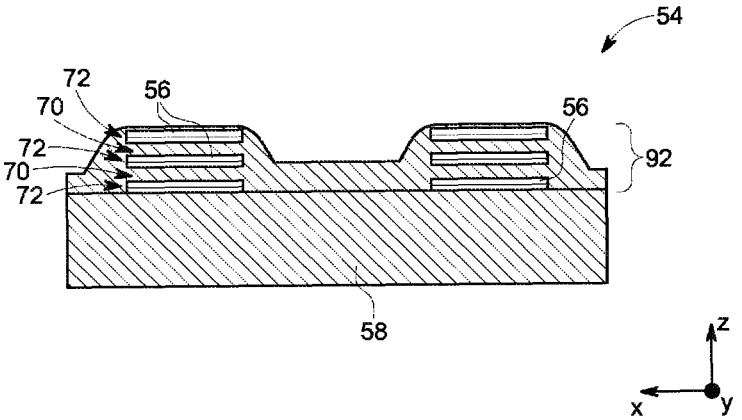
FIG. 14B depicts a cross-sectional side-view of one implementation of an X-ray source incorporating target layers as shown in FIG. 14A, in accordance with aspects of the present disclosure.

The following example combines certain of these features discussed above to show how the present concepts may be related together in a stationary or rotational X-ray source target 54. Turning to FIGS. 14A and B, FIG. 14B depicts an elevational sectional view of an X-ray source target 54 having three X-ray generating layers 72 (in the z-dimension) formed from X-ray generating material 56 (e.g., tungsten) which may or may not be the only material present in the layer 72. Here the X-ray generating material 56 of each layer 72 is formed as a disk or ring, as can be seen in FIG. 14A which depicts an X-ray generating layer 72 as seen from above. Each layer 72 of X-ray generating material 56 is interspersed with thermally conductive layers 70. In one embodiment, the ring-shaped regions of X-ray generating material 56 have an inner diameter of 6 mm and an outer diameter of 9 mm, while the source target 54 has an outer diameter of 9.5 mm. This particular design is intended to accommodate a thermal spot whose maximum dimension is 0.5 mm that hits the target at a radial position of 7.5 mm. The elevational separation as well as the heat conduction afforded by the thermally conductive layers 70 and substrate 58 help to address thermal stresses during operation and to help prevent delamination.

Technical effects of the present embodiments include, but are not limited to a multi-layer source target structure capable of operating at high temperatures. Certain technical embodiments include multiple layer of X-ray generating material that may or may not extend fully across the layer in which they are present. As disclosed herein, the X-ray generating structures are not limited in terms of focal spot size or kV, and thus may apply to focal spots between 100 μm to 1,000 μm, as well as to other focal spot sizes, as well as to 100 kV to 450 kV (or greater) applications.

This written description uses examples to disclose the invention, including the best mode, and also to enable any person skilled in the art to practice the invention, including making and using any devices or systems and performing any incorporated methods. The patentable scope of the invention is defined by the claims, and may include other examples and combinations that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An X-ray source target, comprising:

a structure configured to generate X-rays when impacted by an electron beam, the structure comprising:

two or more X-ray generating layers each comprising X-ray generating material extending less than the full extent of the surface of the structure; and at least one thermally-conductive layer between each pair of X-ray generating layers; and a thermally conductive top-layer deposited over a first X-ray generating layer relative to a cathode-facing surface of the structure, wherein the top layer comprises a thermally conductive material having a thermal conductivity in a range from about 250 W/m-K to about 1700 W/m-K.

2. The X-ray source target of claim 1, wherein each X-ray generating layer comprises a thermally conductive material where there is no X-ray generating material.

3. The X-ray source target of claim 1, wherein the thermally conductive material of the top-layer comprises highly ordered pyrolytic graphite (HOPG), diamond, beryllium oxide, silicon carbide, copper-molybdenum, oxygen-free high thermal conductivity copper (OFHC), silver-diamond, or any combination thereof.

4. The X-ray source target of claim 1, further comprising a thermally-conductive substrate on which a bottommost X-ray generating layer is formed.

5. The X-ray source target of claim 1, wherein the X-ray generating material within at least one X-ray generating layer is ring-shaped.

6. The X-ray source target of claim 1, wherein the X-ray generating material within at least one X-ray generating layer is circular.

7. The X-ray source target of claim 1, further comprising one or more trenches extending at least through the two or more X-ray generating layers.

8. The X-ray source target of claim 1, wherein the structure comprises a stationary anode structure.

9. The X-ray source target of claim 1, wherein the cross-sectional extent of the X-ray generating material within each X-ray generating layer is sized to correspond to the impact area of an electron beam during operation.

10. An X-ray source target, comprising:

a structure configured to generate X-rays when impacted by an electron beam, the structure comprising:

a substrate; and a multi-layer structure formed on the substrate and only partially covering a cathode-facing surface of the substrate, the multi-layer structure comprising:

alternating layers of X-ray generating material and thermally-conductive material; and a thermally conductive top-layer deposited over a first X-ray generating layer relative to the cathode-facing surface of the structure, wherein the top layer comprises a thermally conductive material having a thermal conductivity in a range from about 250 W/m-K to about 1700 W/m-K.

11. The X-ray source target of claim 10, wherein the multi-layer structure comprises a ring-shaped multi-layer structure formed on the substrate.

12. The X-ray source of claim 10, wherein the multi-layer structure comprises one or more trenches extending at least through the multi-layer structure.

13. The X-ray source of claim 12, wherein at least one trench is a ring-shaped trench extending at least through the multi-layer structure.

14. The X-ray source of claim 12, wherein at least one trench is a radial trench extending at least through the multi-layer structure.

15. The X-ray source of claim 14, wherein each radial trench comprises a stress relief feature formed at a terminal end of the respective radial trench.

16. A method for manufacturing a multi-layer X-ray source target, comprising:

forming a thermally-conductive substrate;

forming two or more X-ray generating layers comprising X-ray generating material on the thermally conductive substrate, wherein the X-ray generating material in each X-ray generating layer, when formed, extends less than the full extent of the surface of the substrate;

between each X-ray generating layer, providing a thermally-conductive layer; and disposing a thermally conductive top-layer over a first X-ray generating layer relative to a cathode-facing surface of the structure, wherein the top layer comprises a thermally conductive material having a thermal conductivity in a range from about 250 W/m-K to about 1700 W/m-K.

17. The method of claim 16, wherein at least one of the X-ray generating layers comprises a ring or a plug of the X-ray generating material.

18. The method of claim 16, further comprising cutting trenches within each X-ray generating layer using one or both of a laser or an energetic beam.

19. The method of claim 16, further comprising etching one or more trenches prior to or after forming the two or more X-ray generating layers and the thermally-conductive layers.

20. The method of claim 16, further comprising masking a portion of the thermally-conductive substrate prior to forming the two or more X-ray generating layers and the thermally-conductive layers.

* * * * *